United States Patent [19]

Chaussadas et al.

[11] 4,395,863

[45] Aug. 2, 1983

[54] METHOD OF FORMING COMPOSITE PACKAGES

[75] Inventors: Jean Chaussadas, Deols; Gisele Coudoin, Chateauroux; Claude Martin, Deols; Andre Milliens, Etrechet, all of France

[73] Assignee: The Mead Corporation, Dayton, Ohio

[21] Appl. No.: 328,042

[22] Filed: Dec. 7, 1981

Related U.S. Application Data

[62] Division of Ser. No. 127,096, Mar. 4, 1980, abandoned.

[30] Foreign Application Priority Data

Mar. 9, 1979 [GB] United Kingdom ..... 7908469
Nov. 20, 1979 [GB] United Kingdom ..... 7940128

[51] Int. Cl.[3] ..... B65B 43/00; B65B 43/08; B65B 53/02

[52] U.S. Cl. ..... 53/442; 53/452; 53/469; 493/217

[58] Field of Search ..... 53/442, 459, 452, 469; 493/217, 924; 206/45.33, 497, 432; 229/87 R, 87 H, DIG. 12

[56] References Cited

U.S. PATENT DOCUMENTS

| | | | |
|---|---|---|---|
| 2,494,446 | 1/1950 | Moore | 206/561 X |
| 2,711,346 | 6/1955 | Irwin et al. | 206/497 X |
| 3,257,768 | 6/1966 | Harrison et al. | 53/442 |
| 3,424,306 | 1/1969 | Munck | 206/432 X |
| 3,524,296 | 8/1970 | Piazze | 53/442 X |
| 3,642,124 | 2/1972 | Brown et al. | 206/45.33 |
| 3,885,667 | 5/1975 | Spiegel et al. | 206/461 X |
| 3,922,362 | 11/1975 | Pierce | 206/497 X |
| 4,166,532 | 9/1979 | Tsuchida et al. | 206/497 X |
| 4,205,750 | 6/1980 | Dews | 229/DIG. 12 |

FOREIGN PATENT DOCUMENTS

| | | | |
|---|---|---|---|
| 1206600 | 9/1970 | United Kingdom | 206/432 |

*Primary Examiner*—Horace M. Culver
*Attorney, Agent, or Firm*—Erwin Doerr

[57] ABSTRACT

The invention relates to materials and method for forming composite packages comprising a first flexible material (11) and a second relatively rigid material (12) which are connected together without the use of additional connecting materials. The connection is achieved by causing the flexible material (11) to be deformed to cooperate in tension with interrupted zones (19) of the relatively rigid material (12). Many different packages may be formed for a variety of uses but the invention is particularly suitable for connecting a heat shrinkable plastics body part to a paperboard or like sheet material end part.

2 Claims, 19 Drawing Figures

METHOD OF FORMING COMPOSITE PACKAGES

This application is a division of application Ser. No. 127,096, filed Mar. 4, 1980 and now abandoned.

This invention relates to composite material and to packages formed by the combination of a first flexible material and a second relatively rigid material in which the first material includes a portion bounding a surface of the second material. Such a combination is particularly useful for forming a composite package utilizing the so called heat shrinking technique in which the flexible material is shrunk onto the relatively rigid material whereby the two materials are connected together so that the flexible material provides a body portion of the package and the relatively rigid material provides an end part of the package.

The combination of a flexible material such as sheet plastics and a relatively rigid material such as paperboard, or similar sheet material, to form a package is well known. However, in such known packages it is common practice to secure the plastics material to the paperboard by adhesive or by stapling the two materials together. This is a labour intensive procedure which is inefficient and tends to make manufacture of such packages costly. The present invention combines such composite materials, particularly in the manufacture of packages, to form a strong connection between the materials without the use of additional connecting materials to provide a cost effective product.

Figure 1:
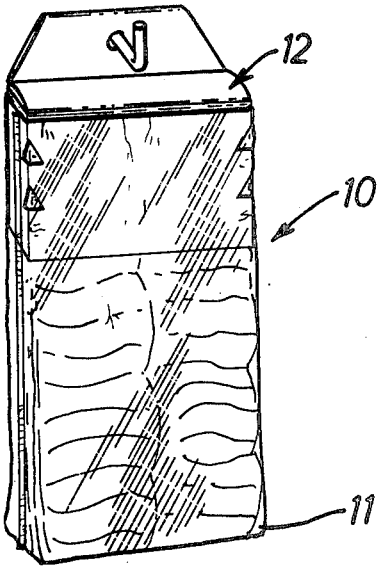
Figure 1A:
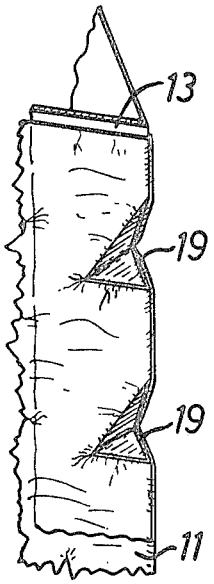
Figure 2:
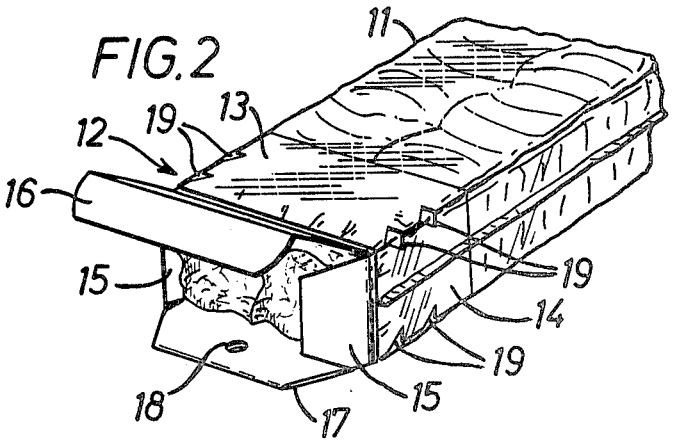
Figure 3:
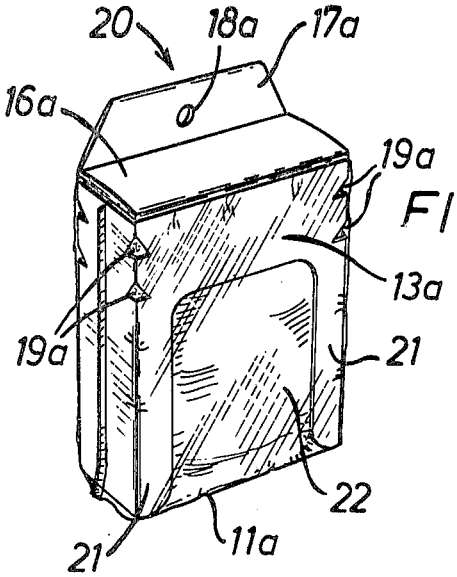
Figure 4:
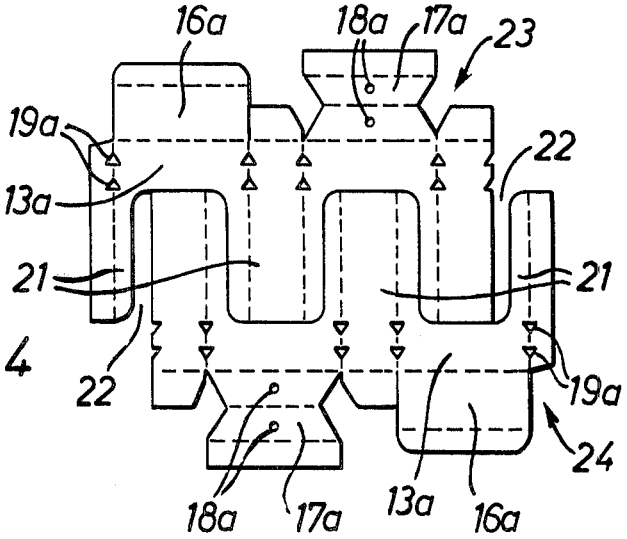
Figure 5:
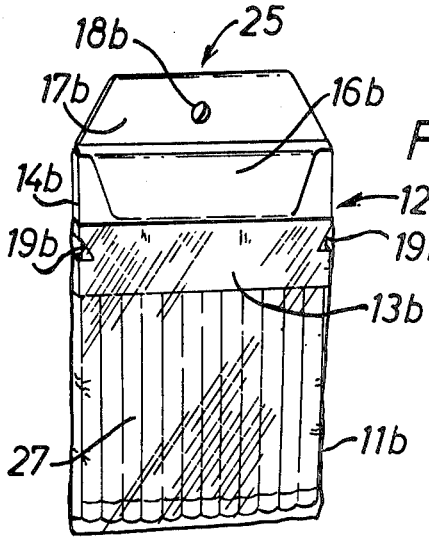
Figure 6:
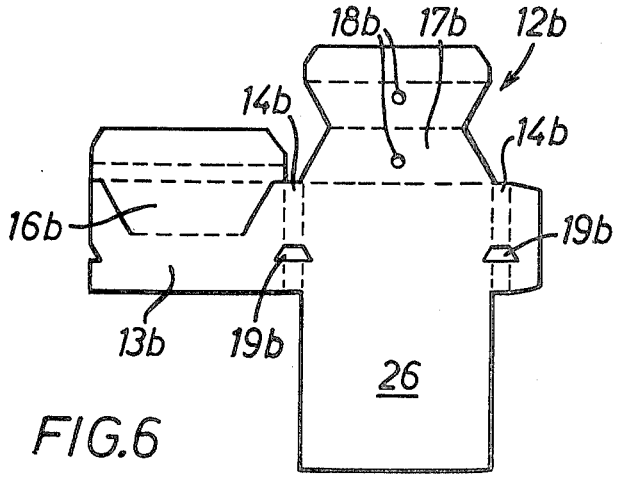
Figure 13:
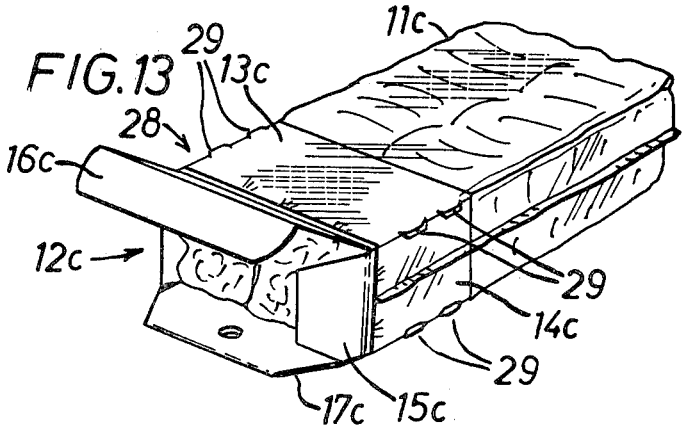
Figure 14:
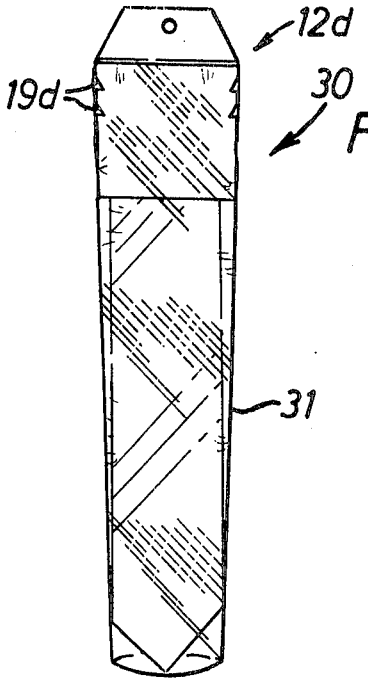
Figure 15:
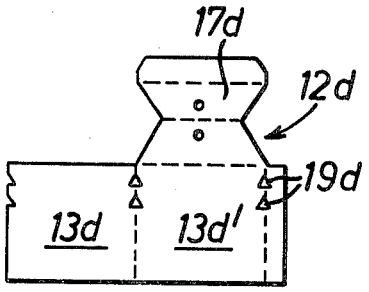
Figure 16:
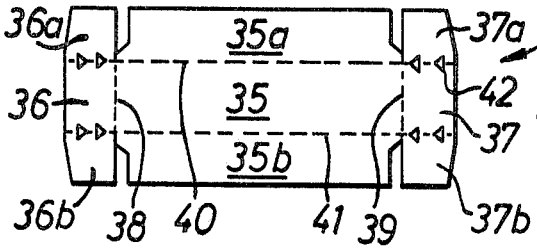
Figure 17:
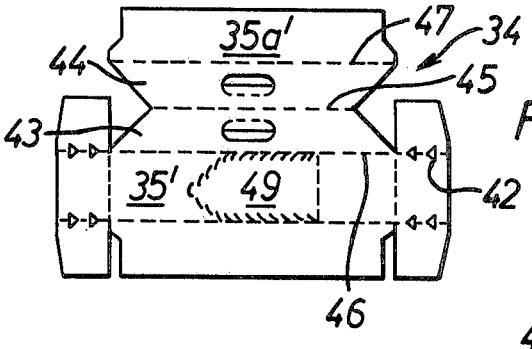
Figure 18:
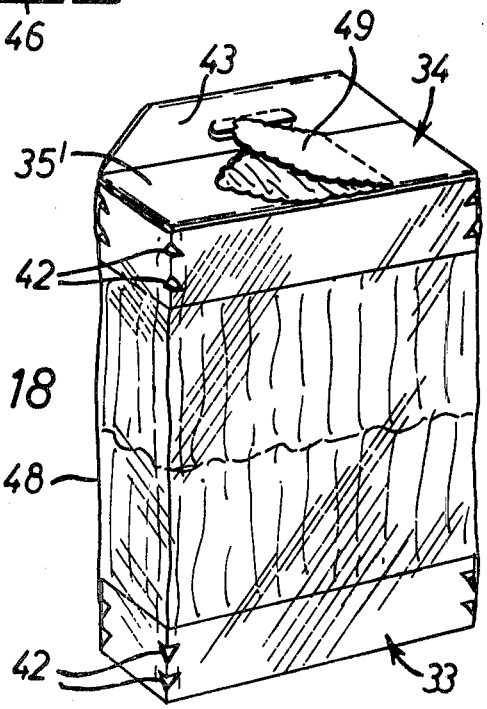

FIG. 1 is a perspective front view of a composite package with a plastics body part shrink-fitted to a paperboard end part, FIG. 1*a* shows a detailed view of one corner of the package, FIG. 2 shows the top closure of the package in more detail, FIG. 3 is a perspective view of a similar composite package, FIG. 4 is a plan view of a pair of nested blanks each for providing the end part of the package illustrated in FIG. 3, FIG. 5 is a front perspective view of a composite package having modified shrink fit openings, FIG. 6 is a plan view of a blank for forming the end closure of the package shown in FIG. 5, FIGS. 7 to 12 show various shapes of openings which may be used to provide means for shrink fitting, FIG. 13 is a perspective view of a further composite package having an end part formed with projections to provide for shrink fitting, FIG. 14 is a front view of another composite package having a body part provided by a plastics sleeve, FIG. 15 is a plan view of a blank for forming the end part of the package shown in FIG. 14, FIG. 16 is a plan view of a blank for forming a base end part of another composite package, FIG. 17 is a similar plan view of a blank for forming a top end part of the same composite package, and FIG. 18 is a perspective view of a composite package Referring now to FIG. 3 of the drawings there is shown a composite package 20 similar to that described with reference to FIGS. 1 and 2 in which like parts are designated with like reference numerals but distinguished by the suffix "a". The package shown in FIG. 3 differs from that previously described in that the top portion 12*a* is extended to provide a pair of legs 21 each of which legs terminate at the base of the bag 11*a* so that the package is free-standing. Each of the legs 21 is formed by an extension of the side walls 14*a* together with an integral extended portion of each of the front and back walls 13*a* of the package. This construction leaves a window 22 formed in each of the front and back walls 13*a*.

FIG. 4 shows a pair of paperboard blanks 23, 24 for forming the top portion 12*a* of the package illustrated in FIG. 3. As can be seen the paperboard portion of the composite package 20 can be struck from a web of paperboard with minimum material waste in that the legs 21 of the one blank nest within the cut out windows 22 of the front and back walls of the other blank.

Referring now to FIG. 5 of the drawings there is shown a further composite package 25 which also is similar to the package 10 shown in FIG. 1 of the drawings. Like parts are designated with like reference numerals but distinguished by the suffix "b". Package 25 comprises a paperboard top portion 12*b* which is slimmer than the paperboard top portion 12 of package 10 in that the side walls 14*b* are of much reduced width as shown in FIG. 6. Hence, the package 25 includes trapezium opening 19*b* which extends across the whole width of the package thereby providing openings at opposite edges of the package which extend from the front wall to the back wall. Nevertheless, the plastics bag 11*b* is secured to the top section 12*b* of the package in a manner similar to that previously described with reference to the deltoid openings. FIG. 6 illustrates a paperboard blank from which the top section 12*b* of the package is formed from which it will be seen that the back wall of the package includes an extended wall 26 to add rigidity to the package and give better protection to the packaged articles 27.

Figure 7:
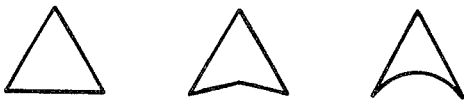
Figure 8:
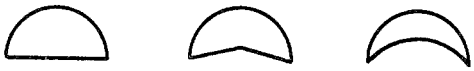
Figure 9:
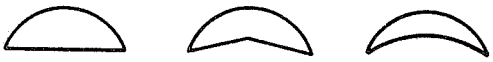
Figure 10:
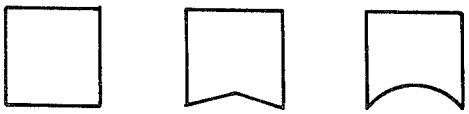
Figure 11:
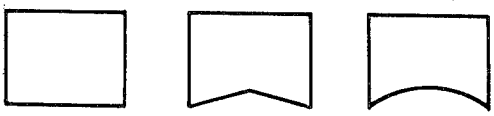
Figure 12:
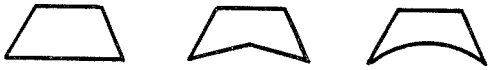

FIGS. 7 to 12 inclusive show various forms of openings which may be struck from the paperboard part of a composite package to provide for the heat shrinkage of the plastics material. The deltoid notch illustrated at the left-hand side in FIG. 7 is that which is used at the corners of the packages illustrated in FIGS. 1, 2 and 3 of the drawings whereas the trapezium aperture shown at the left-hand side in FIG. 12 of the drawings is that which is used in the package illustrated in FIG. 5. The various shapes illustrated are by no means exhaustive, it being understood that many other suitable shapes could be utilized.

Destructive tests have been conducted in order to ascertain the strength and reliability of the connection between the paperboard and plastics material of composite packages according to this invention. In one such test a composite package in which a plastics bag was charged with a load of 1.0 Kg and having a pair of deltoid notches at each corner of the paperboard top portion was subjected to a jerk test in a suitable apparatus operating at a frequency of approximately 46 strokes per minute. It was found that with kraft 365 g paperboard and monorientated PE90$\mu$ plastics film each package tested withstood approximately 1100 strokes prior to failure of the connection between paperboard and plastics.

Referring now to FIG. 13 of the drawings there is shown a further composite package 28, similar to package 10. Like parts are designated with like reference numerals but distinguished by suffix "c". The top portion 12*c* is similar to that shown in FIG. 2 of the drawings and comprises a parallel front and back walls 13*c* connected together by spaced side walls 14*c*. The top of the box includes side panels 15*c* hinged to the side walls 14*c* and a main closing panel 16*c* hinged to front wall 13*c*. Panels 15*c*, 16*c* cooperate to provide a reclosable top by which the package can be filled and by which access to the contents subsequently is gained. The top section 12*c* also includes an integral extension panel 17*c*. In this embodiment, the notches 19 have been replaced by projections comprising tabs 29 struck from the paperboard blank. Each of the corners defined by the junction between walls 13*c* and 14*c* is formed with a pair of outwardly projecting tabs 29 which provide the interrupted zones by which the bag is secured to the top section 12*c*. In this construction, when the bag 11*c* is subjected to heat at those areas which overlay the tabs 29, the plastic material shrinks at least in the vicinity of the tabs 27 so that the plastics is drawn taut across each of the tabs to form areas of tension by which the bag 11*c* and paperboard top 12*c* are connected together. It will be appreciated that a variety of tab shapes may be struck from the paperboard other than the generally rectangular tabs 29 illustrated in the drawings. For example, the tabs may comprise a series saw-tooth serrations struck from the blank although many other shapes may be suitable.

FIG. 14 of the drawings illustrates a further composite package 30. In the package 30 the body part is provided by a plastics sleeve 31 which is shrink fitted to the top part 12*d* of the package. The paperboard top part 12*d* is illustrated in more detail in FIG. 15 of the drawings from which it will be seen that the side walls of the top have been dispensed with so that the top part basically comprises a front and back wall 13*d*, and an extension portion 17*d* by which the completed package can be suspended at point of sale. Deltoid notches 19*d* are struck from the blank at the edges of the front and back walls so that when the top portion is completed notches for shrink fitting the sleeve 31 are provided at opposite edges of the top portion. In a modified version (not shown) the back wall may be dispensed with, in which case the notches provided for shrink-fitting may comprise notched out areas of the opposed edges of the paperboard. Package 30 is particularly suitable for the packaging of flat articles such as that shown and in a further modification may comprise an extended strengthening wall (not shown) such as the panel 26 described with reference to FIG. 6.

FIG. 18 of the drawings show a further package 32 in which the body part of the package also comprises a plastic sleeve as in the previous embodiment. However, unlike the package 30 of the previous embodiment this package is particularly suitable for the packaging of folded bulky items and includes a paperboard base element 33 in addition to a paperboard top element.

The paperboard base element 33 is shown in more detail in FIG. 16 of the drawings whereas the paperboard top element 34 is shown in more detail in FIG. 17 of the drawings. Referring to FIG. 16 the blank for forming the base element 33 comprises a central panel 35 to which is foldably joined side panels 36, 37 along transverse fold lines 38, 39 respectively. The panel 36 includes a pair of foldably joined corner panels 36*a*, 36*b* and similarly the panel 37 includes foldably joined corner panels 37*a*, 37*b*. The central panel 35 has foldably joined along its longitudinal edges a pair of flank panels 35*a*, 35*b* respectively which are hinged to the main panel 35 along fold lines 40, 41 respectively. The fold lines 40, 41 extend the whole length of the blank and also provide the fold lines by which the corner panels are foldably joined to their respective end panels 36 and 37. Deltoid openings are struck from the blank along fold lines 40 and 41 to provide notches 42 in the erected base part 33 to provide for heat shrinkage of the plastics material as previously described.

To erect the blank into the base end part 33 of the composite package, the flank panels 35*a*, 35*b* are folded up in the same direction about fold lines 40, 41 respectively so as to bring the flank panels perpendicular to the centre panel 35. Similarly, the end panels 36, 37 are folded upwardly in the same direction as the flank panels about their respective fold lines 38, 39 and subsequently the corner panels 36*a*, 36*b*, 37*a*, 37*b* are overlapped against the upstanding flank panels 35*a*, 35*b* and secured in position. Thus the erected blank is brought into the configuration of an open topped box or tray and is used to provide the base part of the composite package 32 shown in FIG. 18.

The top closure 34 of the package 32 is depicted in FIG. 17 of the drawings. This top closure 34 fundamentally is similar to the base tray end part 33 shown on FIG. 16 with the exception that a two part handle structure has been interposed between centre panel 35' and flank panel 35*a*. The handle structure comprises a pair of handle panels 43, 44 which are mirror images of one another about a central fold line 45. Other parts of the top closure similar to like parts of the base tray are designated with similar reference numerals. The handle panel 43 is foldably joined to the centre panel 35' along fold line 46 and the handle panel 44 is foldably joined to the flank panel 35*a'* along fold line 47.

The plastic sleeve 48 of the composite package 32 is heat shrink fitted to both the base end part 33 and the top end part 34 by means of the deltoid notches 42, 42' by causing the plastics material to shrink in the areas overlaying the notches so as to provide the connection as previously described. It is of course, necessary to fill the package before the top closure 34 or the base closure 33 is connected with the plastic sleeve 48. To provide access to the contents of the package a tear-away panel section 49 is provided in the central panel 35'.

It is envisaged that it may not be necessary to provide openings, as shown, in each corner of the top and/or base elements of the package but in some cases it may be sufficient to provide such openings only in the diagonally opposite corners of each end part. Moreover, it also is envisaged that the notches need not be completely struck out from the blank so as to provide an opening but the material may only be scored leaving the central part defined by the score lines weakened but still attached to the paperboard. Nevertheless, the plastics material when shrink-fitted will still tend to be drawn into the areas defined by the scored notches in order to provide the means by which the plastics is secured to the paperboard. Such a construction may be desirable where it is necessary to protect the contents of the package from being adhered to the plastics material drawn into the notched areas of the paperboard.

Although the composite packages described have referred to the use of a heat shrinkable plastics material, it is also envisaged that other suitable material may be used. For example, material which can be shrink fitted other than by means of heating is within the scope of the invention. It is also envisaged that a material which is stretchable but yet retains some degree is resilience would be suitable. In this case the material could be initially maintained in a stretched condition during introduction of the paperboard or other similar sheet material. When the first material is released it should be sufficiently resilient to engage at least the interrupted zones of the second material such that the two materials are held connected together.

We claim:

1. In a method of packaging a product in a composite package which comprises a tubular top section of paperboard having closure panels at the top and interruptions at the corners of angularly related side walls thereof, and a bag of heat shrinkable film material adapted to accommodate said product, the steps of (a) bringing together said top section and said bag so that the mouth of the bag overlaps a portion of the top section to cover said interruptions, (b) causing at least local areas of said bag which cover said interruptions to be heated so that said local areas of the bag are drawn into tension across said interruptions whereby the bag becomes attached to said top section, (c) inserting said product into the bag through said top section, and thereafter (d) closing the closure panels associated with said top section.

2. A composite package formed in accordance with claim 1.

* * * * *